United States Patent [19]

Clegg

[11] Patent Number: 4,598,226

[45] Date of Patent: Jul. 1, 1986

[54] CONCAVE CONICAL FOIL-FILAMENT LAMP

[76] Inventor: John E. Clegg, 2320 Keystone Dr., Orlando, Fla. 32806

[21] Appl. No.: 682,215

[22] Filed: Dec. 17, 1984

[51] Int. Cl.[4] ..... H01J 1/15

[52] U.S. Cl. ..... 313/341; 313/343; 313/315

[58] Field of Search ..... 313/264, 271, 274, 341, 313/113; 445/27

[56] References Cited

U.S. PATENT DOCUMENTS

| | | | |
|---|---|---|---|
| 2,007,939 | 7/1935 | Braselton | 313/341 |
| 2,319,338 | 5/1943 | Mulder | 313/341 |
| 3,612,942 | 10/1971 | Peyrot | 313/341 |
| 3,775,609 | 11/1973 | Dank | 313/113 |
| 3,788,721 | 1/1974 | Vause | 445/27 |
| 4,144,473 | 3/1979 | Almer | 313/315 |

*Primary Examiner*—David K. Moore
*Assistant Examiner*—T. Salindong

[57] ABSTRACT

An incandescent electric lamp with a concave conical foil filament suspended by mounting tabs inside a ring conductor between concave conical front and rear bulb walls. Current flows from a center post conductor through the foil filament to the ring conductor to the base. A reflective plate is mounted behind the foil filament to return heat to the filament.

1 Claim, 2 Drawing Figures

CONCAVE CONICAL FOIL-FILAMENT LAMP

BACKGROUND

Prior art includes three U.S. Pat. Nos. 2,007,939, 3,788,721 and 4,144,473. The first patent features a tubular filament, the second a flat rectangular filament and the third a hollow cylindrical filament.

The disclosed lamp emits a convergent conical beam and is designed primarily for use with an illuminator for microscopes.

DRAWINGS

DESCRIPTION

Figure 1:
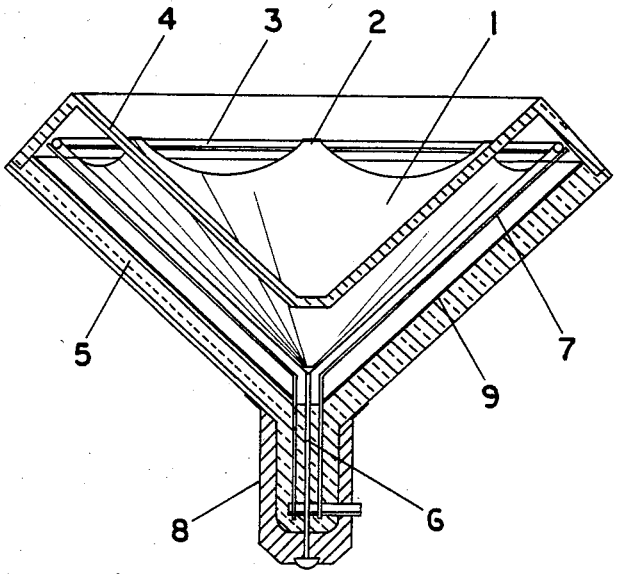
FIG. 1 is an elevation of the concave conical foil-filament lamp.

FIG. 1 is an elevation of the concave conical foil-filament lamp showing concave conical foil filament 1 suspended by mounting tabs 2 inside ring conductor 3 between concave conical front bulb wall 4 and concave conical rear bulb wall 5. Current flows from center post conductor 6 through foil filament 1 to ring conductor 3 through post conductors 7 to base 8.

A concave conical reflective plate 9 is mounted on rear bulb wall 5 behind foil filament 1. The purpose of reflective plate 9 is to intercept the beam emitted by the rear wall of the filament and reflect the beam back onto the filament as means of increasing the incandescence of the filament.

Figure 2:
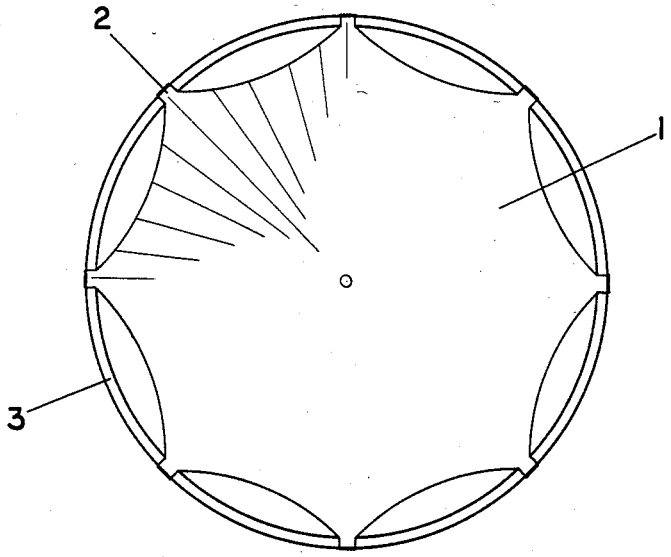
FIG. 2 is a view of the foil filament and ring conductor.

Foil filament 1 is defined by two opposed parallel concave conical front and rear walls and by a circular perimeter with arcuate indentations separating mounting tabs 2 as shown in FIG. 2. The light rays projected perpendicular from the front wall of foil filament 1 form an afocal convergent conical beam (not shown) which is transmitted through transparent front bulb wall 4 into a conical lens (not shown) of a microscope illuminator.

Ring conductor 3 is a continuous annular steel wire mounted on four post conductors 7.

The four post conductors 7 are rigid steel wires, each having a straight portion parallel to the center post conductor 6 and having an angular portion extending outward to engage the ring conductor 3 as means of supporting same.

I claim:

1. A concave conical foil-filament lamp comprising a concave conical foil filament (1) suspended by mounting tabs (2) inside a ring conductor (3) between a concave conical front bulb wall (4) and a concave conical rear bulb wall (5), with a concave conical reflective plate (9) mounted between foil filament (1) and concave conical rear bulb wall (5).

* * * * *